US009269554B2

(12) United States Patent
Brown et al.

(10) Patent No.: US 9,269,554 B2
(45) Date of Patent: Feb. 23, 2016

(54) CRYOGENIC COLLISIONAL COOLING CELL

(71) Applicant: Micromass UK Limited, Wilmslow (GB)

(72) Inventors: Jeffery Mark Brown, Hyde (GB); Jason Lee Wildgoose, Stockport (GB)

(73) Assignee: Micromass UK Limited, Wilmslow (GB)

( * ) Notice: Subject to any disclaimer, the term of this patent is extended or adjusted under 35 U.S.C. 154(b) by 0 days.

(21) Appl. No.: 14/401,156

(22) PCT Filed: May 8, 2013

(86) PCT No.: PCT/GB2013/051191

§ 371 (c)(1),
(2) Date: Nov. 14, 2014

(87) PCT Pub. No.: WO2013/171458

PCT Pub. Date: Nov. 21, 2013

(65) Prior Publication Data

US 2015/0155149 A1 Jun. 4, 2015

Related U.S. Application Data

(60) Provisional application No. 61/650,018, filed on May 22, 2012.

(30) Foreign Application Priority Data

May 18, 2012 (GB) ..... 1208812.6

(51) Int. Cl.

| | |
|---|---|
| ***H01J 49/04*** | (2006.01) |
| ***H01J 49/00*** | (2006.01) |
| ***H01J 49/40*** | (2006.01) |

(52) U.S. Cl.
CPC ..... *H01J 49/0481* (2013.01); *H01J 49/0031* (2013.01); *H01J 49/401* (2013.01)

(58) Field of Classification Search
CPC ... H01J 49/0481; H01J 49/40; H01J 49/0468; H01J 49/0422; H01J 49/164; H01J 49/0418; H01J 49/26; H01J 27/022; B01D 59/44; G01N 1/22; G01N 27/622
USPC ..... 250/281, 282, 287, 288, 424, 423 R, 250/423 P
See application file for complete search history.

(56) References Cited

U.S. PATENT DOCUMENTS

| | | | | |
|---|---|---|---|---|
| 4,885,470 | A | 12/1989 | Abbott | |
| 5,459,315 | A | 10/1995 | Waki | |
| 6,104,028 | A * | 8/2000 | Hunter et al. | 250/288 |

(Continued)

*Primary Examiner* — David A Vanore
(74) *Attorney, Agent, or Firm* — Diederiks & Whitelaw, PLC

(57) ABSTRACT

A mass spectrometer is disclosed comprising a cooling cell for cooling ions so as to reduce their kinetic energy. The cooling cell comprises: a chamber for receiving the ions or for generating the ions therein, wherein said chamber is formed from walls defining a substantially enclosed region; and a cooling jacket surrounding said chamber, wherein said cooling jacket is arranged and configured to contain a cooling fluid and so as to remove heat from one or more walls of the chamber. The mass spectrometer further comprises a mass analyzer for receiving ions from the cooling cell after they have been cooled. The present invention reduced the kinetic energy of the ions prior to mass analysis and hence improves the resolution of the mass analyzer. The mass analyzer is preferably a time of flight mass analyzer.

27 Claims, 4 Drawing Sheets

(56) References Cited

U.S. PATENT DOCUMENTS

| | | | | |
|---|---|---|---|---|
| 6,498,342 | B1 | 12/2002 | Clemmer | |
| 7,071,467 | B2 * | 7/2006 | Bateman et al. | 250/292 |
| 7,077,944 | B2 | 7/2006 | Clemmer | |
| 7,217,921 | B2 | 5/2007 | Guevremont et al. | |
| 7,928,363 | B2 * | 4/2011 | Bateman | 250/283 |
| 8,575,544 | B1 * | 11/2013 | Kelly et al. | 250/287 |
| 8,779,354 | B2 | 7/2014 | Green et al. | |
| 2002/0026821 | A1 * | 3/2002 | Zimmermann et al. | 73/23.35 |
| 2003/0168586 | A1 * | 9/2003 | Yamaguchi et al. | 250/281 |
| 2004/0079873 | A1 * | 4/2004 | Bateman et al. | 250/281 |
| 2005/0258364 | A1 * | 11/2005 | Whitehouse et al. | 250/292 |
| 2006/0113464 | A1 * | 6/2006 | Litherland et al. | 250/288 |
| 2007/0023627 | A1 * | 2/2007 | Finch et al. | 250/282 |
| 2008/0001081 | A1 * | 1/2008 | Jindai et al. | 250/287 |
| 2010/0072360 | A1 * | 3/2010 | Green et al. | 250/282 |
| 2010/0200742 | A1 * | 8/2010 | Schultz et al. | 250/252.1 |
| 2015/0034814 | A1 * | 2/2015 | Brown et al. | 250/282 |

* cited by examiner

CRYOGENIC COLLISIONAL COOLING CELL

CROSS REFERENCE TO RELATED APPLICATIONS

This application is the National Stage of International Application No. PCT/GB2013/051191, filed 8 May 2013, which claims priority from and the benefit of U.S. provisional patent application Ser. No. 61/650,018 filed on 22 May 2012 and United Kingdom patent application No. 1208812.6 filed on 18 May 2012. The entire contents of these applications are incorporated herein by reference.

BACKGROUND OF THE PRESENT INVENTION

The present invention relates to apparatus and methods for improving the resolving power of mass analysers.

It is known that the dominant aberration that limits the resolution of high performance time of flight (TOF) mass analysers is due to the ion 'turn around time'. The ultimate resolution of a TOF mass analyser is therefore fundamentally limited to a value that is inversely proportional to the orthogonal velocity spread of the ions being analysed and so it is desirable to reduce this as much as possible. Other aberrations are less difficult to correct, such as spatial focusing, mechanical tolerances and detection line width.

The aberration due to the ion turn around time in a TOF mass analyser, $d_{TOF}$, may be defined as $d_{TOF}F=2u/a$, where 'u' is the initial orthogonal velocity component of an ion and 'a' is the acceleration provided to the ion by the electric field generated by the pusher in the extraction region of the TOF mass analyser. The aberration due to the ion turn around time can therefore be reduced by reducing the initial velocity component of the ion 'u' or by increasing the acceleration of the ion 'a'. A known technique to reduce the initial velocity component 'u' and hence reduce the ion turn around time involves the use of an Einzel transfer lens positioned upstream of the pusher assembly of the TOF mass analyser. The lens is designed to magnify the physical size of the ion beam whilst reducing its orthogonal velocity component. However, this system has the disadvantage of requiring a relatively large region for defining the pusher electric field.

It is also possible to reduce the orthogonal velocity spread of ions by using a mechanical slit to restrict the passage of ions with high orthogonal velocity 'u' to the pusher region. The ions may be directed towards the slit along an axis through the slit. By the time that the ions reach the slit only the ions having relatively low orthogonal velocities will remain close enough to the axis to pass through the slit and be sampled by the pusher electrode of the TOF mass analyser. The other ions are blocked by the slit. This method of rejecting ions by collimating the ion beam has the advantage of increasing the TOF mass resolution of the ions transmitted through the slit, but has the disadvantage of reducing the instrument sensitivity since the ions that are blocked by the slit cannot be mass analysed. Furthermore, if the axial energy of the ions is not high enough then electrical potentials on the surfaces of the slit may affect the passage of ions that pass through the slit.

Another technique for reducing the turn around time is to use a greater electric field to increase the acceleration of the ions 'a'. This may be achieved by applying higher voltages to the pusher electrodes of the TOF mass analyser or by applying the same potential difference over a shorter length. However, higher voltage supplies use and dissipate more power and are more expensive. Also, the application of relatively high potential differences over relatively short lengths can lead to electrical breakdowns.

It is therefore desired to provide an improved mass spectrometer and improved method of mass spectrometry.

SUMMARY OF THE PRESENT INVENTION

The present invention provides a mass spectrometer comprising: a cooling cell for cooling ions so as to reduce their kinetic energy, the cooling cell comprising: a chamber for receiving said ions or for generating said ions therein, said chamber being formed from walls defining a substantially enclosed region; and a cooling jacket surrounding said chamber, wherein said cooling jacket is arranged and configured to contain a cooling fluid and so as to remove heat from one or more walls of the chamber; wherein the mass spectrometer further comprises a mass analyser for receiving said ions from the cooling cell.

The present invention reduces the kinetic energy of the ions and their range of velocities and so provides improved resolution when the ions are mass analysed, particularly in a TOF mass analyser as the aberration due to the ion turn around time is reduced.

The cooling jacket preferably comprises a fluid inlet line for receiving said cooling fluid and a fluid outlet line for venting the cooling fluid out of the cooling jacket. This enables freshly cooled cooling fluid to be circulated around the walls of the cooling cell chamber and then removed from the cooling jacket so as to carry the absorbed heat away from the chamber. The apparatus preferably comprises means such as a pump for flowing the cooling fluid into the jacket through the inlet line, through the jacket and then out of the jacket through the outlet line. The cooling fluid that leaves the cooling jacket may then be refrigerated and recycled back into the inlet line of the cooling jacket. Any suitable refrigeration technique may be used to achieve this. The cooling fluid is preferably a liquid, although it may less preferably be a vapour or gas. Examples of cooling fluids include liquid, vapour or gaseous phase nitrogen or helium.

At least a portion of the inlet line and/or outlet line may be connected to a mounting surface in the mass spectrometer in a manner so that it may move relative to the mounting surface so as to accommodate thermal expansion or contraction of the inlet line and/or outlet line. For example, a bellows mechanism may be used to mount a portion of the inlet and/or outlet line, wherein the bellows mechanism changes in length as the length of the line expands or contracts and so maintains the line coupled to the mounting surface.

A gas line may be provided through a wall of the chamber for supplying bath gas into the chamber. This gas is then cooled inside of the chamber as a result of the cooling fluid in the cooling jacket having cooled the wall of the chamber. The molecules of the cooled gas collide with the ions inside of the chamber and remove energy from the ions by collisional cooling. This energy is in turn removed from the gas by the cooled wall of the chamber, which is then removed from the wall of the chamber by the cooling jacket.

The one or more walls of the chamber preferably define a substantially enclosed region for containing the bath gas, preferably such that a pressure difference exists between the inside and outside of the chamber. The cooling cell is preferably housed in a vacuum chamber.

Preferably, the chamber comprises an ion entrance aperture for allowing the chamber to receive ions to be cooled, an ion exit aperture for allowing cooled ions to exit the chamber, and further comprising a gas-line inlet opening for allowing the chamber to receive gas to be cooled. The walls of the cooling chamber may define a fully enclosed region except for said ion entrance aperture, said ion exit aperture and said gas-line inlet opening.

Means may be provided for controllably varying the gas flow rate into the gas line or gas-line inlet opening so as to selectively vary the gas pressure inside the cooling cell chamber. This may be used to select the gas pressure inside the chamber and hence the rate at which the ions are cooled. Alternatively, or additionally, means may be provided for controllably varying the gas flow rate out of the cooling cell chamber so as to selectively vary the gas pressure inside the chamber. This may also be used to select the gas pressure inside the chamber and hence the rate at which the ions are cooled.

The chamber is preferably an elongated chamber having an ion entrance aperture and an ion exit aperture at opposing longitudinal ends of the chamber, and wherein the gas inlet-line opening is arranged through a chamber wall in a longitudinally central region of the chamber between the longitudinal ends of the chamber. The opening is preferably mid-way along the chamber.

The cooling cell is preferably arranged in a vacuum housing or between vacuum housings such that, in use, the gas pressure inside the cooling cell chamber is higher than the gas pressure of said vacuum housing(s). The gas pressure outside the chamber at the ion entrance aperture and/or the ion exit aperture is preferably lower than the gas pressure inside the chamber, for example, as compared to the centre of the chamber. The low pressure regions outside of the chamber allow the ions to be transferred through the mass spectrometer easily, whereas the higher pressure region within the cooling cell chamber enables the ions to be cooled efficiently by collisional cooling between the ions and the gas in the chamber.

The gas inlet line preferably extends through a channel through the cooling jacket to reach the cooling cell chamber. This enables the cooling jacket to surround the cooling cell chamber for optimum cooling, whilst enabling gas to be delivered into the desired portion of the chamber.

The chamber is preferably an elongated chamber that extends between ends having an ion entrance aperture and an ion exit aperture, and the cooling jacket may be wrapped around the circumference of the chamber between said ends.

The mass spectrometer preferably further comprises means for generating electric and/or magnetic fields for confining ions within the chamber such that the ions do not impact on one or more walls of the chamber. An ion guide or ion trap having a plurality of electrodes may be arranged in the chamber and one or more voltage supply may supply one or more voltages to these electrodes so as to confine the ions within the ion guide or ion trap. RF voltages may be applied to these electrodes so as to confine the ions. The ion guide or ion trap may be formed from a multipole rod set or a plurality of apertured electrodes arranged with the apertures aligned so as to form an ion tunnel. However, ion guides or ion traps having alternative electrode structures may be employed.

The chamber comprises an exit aperture through which ions may be arranged to exit for passage into the mass analyser. An ion guide is preferably arranged to pass ions out of this exit aperture. The cooling cell may comprise means to drive ions through the chamber and out of the exit aperture, such as an electrode arrangement to apply a DC voltage gradient along the chamber. This may be useful for driving the ions through the bath gas in the cooling cell. Alternatively, a gas flow may be arranged to direct ions out of the exit aperture. The chamber preferably also comprises a separate entrance aperture through which ions may enter into the chamber. An ion guide is preferably arranged so as to guide ions from the entrance aperture to the exit aperture.

The cooling jacket is preferably arranged between one or more of the chamber walls and a thermal insulating layer. This helps prevent the cooling jacket from absorbing heat from the atmosphere outside of the chamber and hence reduces the burden on the refrigeration system that re-cools and recycles the cooling fluid.

The mass analyser is arranged and the mass spectrometer is configured such that ions cooled by the cooling cell are received at the mass analyser whilst still cooled relative to their kinetic energies prior to the ions entered the cooling cell.

The mass analyser is preferably a time of flight mass analyser and even more preferably an orthogonal acceleration time of flight mass analyser. The present invention is particularly advantageous with such types of mass analyser as it reduces kinetic energy of the ions and reduces the turn around time aberration and hence improves resolution. However, it is contemplated that the present invention could be used with other types of mass analyser so as to improve the mass analysis.

The cooling cell itself is considered to be novel in its own right and from another aspect the present invention therefore provides a cooling cell for cooling ions so as to reduce their kinetic energy, the cooling cell comprising: a chamber for receiving said ions or for generating said ions therein, said chamber being formed from wall defining a substantially enclosed region; and a cooling jacket surrounding said chamber, wherein said cooling jacket is arranged and configured to contain a cooling fluid and so as to remove heat from one or more walls of the chamber.

The cooling cell may have any one or combination of features described herein above in relation to the cooling cell of the mass spectrometer.

The present invention also provides a method of mass spectrometry comprising: providing an ion cooling cell comprising a chamber having walls defining a substantially enclosed region and a cooling jacket surrounding said chamber; providing ions in said chamber; supplying a cooling fluid into the cooling jacket so as to remove heat from one or more walls of the chamber, thereby cooling a gas within the chamber and the ions within the chamber; and mass analysing the cooled ions.

The method may comprise using a mass spectrometer as discussed herein above.

The method preferably further comprises flowing said cooling fluid into the jacket through an inlet line, through the jacket and then out of the jacket through an outlet line. The cooling fluid exiting the jacket through the outlet line may be cooled and recycled back into the jacket through the inlet line.

The method may further comprise supplying the gas into the chamber through a wall of the chamber.

The chamber preferably comprises an ion entrance aperture and an ion exit aperture, and the gas may be supplied into the chamber at a rate such that the gas pressure within the chamber is higher than the gas pressure outside of the chamber at the ion entrance aperture and/or ion exit aperture.

The ions may be confined within the chamber using electric and/or magnetic fields such that the ions do not impact on the one or more walls of the chamber.

The method may further comprise urging ions through the chamber and out of an exit aperture of the chamber.

The method preferably comprises mass analysing the ions in a time of flight mass analyser, and more preferably an orthogonal acceleration time of flight mass analyser.

The present invention also provides a method of cooling ions comprising: providing an ion cooling cell comprising a chamber having walls defining a substantially enclosed region and a cooling jacket surrounding said chamber; providing ions in said chamber; and supplying a cooling fluid into the cooling jacket so as to remove heat from one or more walls of the chamber, thereby cooling a gas within the chamber and the ions within the chamber.

The method of cooling ions may include any one or any combination of any two or more of the features described hereinabove in relation to the method of cooling ions in the method of mass spectrometry.

The concept of reducing the kinetic energy of ions in order to improve mass analysis and the detection of the ions' mass to charge ratios is believed to be novel in its own right. The present invention therefore provides a method of mass spectrometry comprising: supplying ions to an ion cooling region; cooling the ions to a cooled state by removing kinetic energy from the ions; supplying ions in the cooled state to a mass analyser; and mass analysing the ions.

The ions are preferably cooled directly by laser cooling or may be cooled indirectly by sympathetic laser cooling. Such forms of laser cooling are known in the art for other purposes such as reducing the energy of ions in order to enable them to be trapped. However, it is not thought to be known to use laser cooling in order to cool ions so that the cooled ions can be mass analysed with improved resolution. For the avoidance of doubt, the term sympathetic laser cooling used herein is intended to mean that a laser is used to cool particles and those particles then interact with the ions in order to cool the ions. For example, the particles may be atomic ions that are cooled directly by laser cooling and the cooled atomic ions then interact with the other ions to be mass analysed so as to cool those other ions. This technique is useful for cooling ions that are unable to be cooled directly by laser cooling, such as ions from large organic molecules.

The present invention also envisages cooling ions (i.e. reducing the kinetic energy of ions) that are generated with the use of a target plate. For example, these techniques may be used in order to improve mass resolution during mass analysis of the ions generated using the target plates. These techniques could also be used to cool the ions for other purposes, such as to improve the trapping of the ions.

Accordingly, from another aspect the present invention provides a method of mass spectrometry comprising: providing a target plate having analyte disposed thereon; cooling the target plate; firing a laser at said analyte arranged on the cooled target plate so as to generate analyte ions; and mass analysing said ions.

From another aspect the present invention provides a method of mass spectrometry comprising: providing a target plate for fragmenting ions; cooling the target plate; directing precursor ions onto the cooled target plate such that the precursor ions fragment into daughter ions; and mass analysing said daughter ions.

The target plate in latter two methods described above may be cooled by using a cooling fluid to conduct heat away from the target plate.

In the above methods that utilise the target plates, the ions may be mass analysed by a time of flight mass analyser, optionally an orthogonal acceleration time of flight mass analyser.

The present invention also provides a mass spectrometer comprising: a target plate on which analyte is disposed in use; means for cooling the target plate; means for generating and directing laser light onto said target plate so that, in use, said laser light strikes said analyte and generates analyte ions; and a mass analyser for mass analysing said analyte ions.

The present invention also provides a mass spectrometer comprising: a target plate for fragmenting ions that impact on said target plate; means for cooling the target plate; means for directing precursor ions onto the target plate such that, in use, the precursor ions impact the target plate and fragment into daughter ions; and a mass analyser for mass analysing said daughter ions.

The above mass spectrometers that comprise the target plates may comprise means for supplying fluid coolant to the target plate for conducting heat away from the target plate.

In the above mass spectrometers that comprise the target plates the mass analyser is preferably a time of flight mass analyser, optionally an orthogonal acceleration time of flight mass analyser.

General optional features of each of the mass spectrometers described herein will be described below. The mass spectrometer may further comprise:

(a) an ion source selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; (xviii) a Thermospray ion source; (xix) an Atmospheric Sampling Glow Discharge Ionisation ("ASGDI") ion source; (xx) a Glow Discharge ("GD") ion source; (xxi) an Impactor ion source; (xxii) a Direct Analysis in Real Time ("DART") ion source; (xxiii) a Laserspray Ionisation ("LSI") ion source; (xxiv) a Sonicspray Ionisation ("SSI") ion source; (xxv) a Matrix Assisted Inlet Ionisation ("MAII") ion source; and (xxvi) a Solvent Assisted Inlet Ionisation ("SAII") ion source; and/or (b) one or more continuous or pulsed ion sources; and/or (c) one or more ion guides; and/or (d) one or more ion mobility separation devices and/or one or more Field Asymmetric Ion Mobility Spectrometer devices; and/or (e) one or more ion traps or one or more ion trapping regions; and/or (f) one or more collision, fragmentation or reaction cells selected from the group consisting of: (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device;

(xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device; and/or (g) a mass analyser selected from the group consisting of: (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic or orbitrap mass analyser; (x) a Fourier Transform electrostatic or orbitrap mass analyser; (xi) a Fourier Transform mass analyser; (xii) a Time of Flight mass analyser; (xiii) an orthogonal acceleration Time of Flight mass analyser; and (xiv) a linear acceleration Time of Flight mass analyser; and/or (h) one or more energy analysers or electrostatic energy analysers; and/or (i) one or more ion detectors; and/or (j) one or more mass filters selected from the group consisting of: (i) a quadrupole mass filter; (ii) a 2D or linear quadrupole ion trap; (iii) a Paul or 3D quadrupole ion trap; (iv) a Penning ion trap; (v) an ion trap; (vi) a magnetic sector mass filter; (vii) a Time of Flight mass filter; and (viii) a Wien filter; and/or (k) a device or ion gate for pulsing ions; and/or (l) a device for converting a substantially continuous ion beam into a pulsed ion beam.

The mass spectrometer may further comprise either:

(i) a C-trap and an Orbitrap™ mass analyser comprising an outer barrel-like electrode and a coaxial inner spindle-like electrode, wherein in a first mode of operation ions are transmitted to the C-trap and are then injected into the Orbitrap™ mass analyser and wherein in a second mode of operation ions are transmitted to the C-trap and then to a collision cell or Electron Transfer Dissociation device wherein at least some ions are fragmented into fragment ions, and wherein the fragment ions are then transmitted to the C-trap before being injected into the Orbitrap™ mass analyser; and/or (ii) a stacked ring ion guide comprising a plurality of electrodes each having an aperture through which ions are transmitted in use and wherein the spacing of the electrodes increases along the length of the ion path, and wherein the apertures in the electrodes in an upstream section of the ion guide have a first diameter and wherein the apertures in the electrodes in a downstream section of the ion guide have a second diameter which is smaller than the first diameter, and wherein opposite phases of an AC or RF voltage are applied, in use, to successive electrodes.

According to an embodiment the mass spectrometer further comprises a device arranged and adapted to supply an AC or RF voltage to the electrodes. The AC or RF voltage preferably has an amplitude selected from the group consisting of: (i)<50 V peak to peak; (ii) 50-100 V peak to peak; (iii) 100-150 V peak to peak; (iv) 150-200 V peak to peak; (v) 200-250 V peak to peak; (vi) 250-300 V peak to peak; (vii) 300-350 V peak to peak; (viii) 350-400 V peak to peak; (ix) 400-450 V peak to peak; (x) 450-500 V peak to peak; and (xi) >500 V peak to peak.

The AC or RF voltage preferably has a frequency selected from the group consisting of: (i)<100 kHz; (ii) 100-200 kHz; (iii) 200-300 kHz; (iv) 300-400 kHz; (v) 400-500 kHz; (vi) 0.5-1.0 MHz; (vii) 1.0-1.5 MHz; (viii) 1.5-2.0 MHz; (ix) 2.0-2.5 MHz; (x) 2.5-3.0 MHz; (xi) 3.0-3.5 MHz; (xii) 3.5-4.0 MHz; (xiii) 4.0-4.5 MHz; (xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; (xx) 7.5-8.0 MHz; (xxi) 8.0-8.5 MHz; (xxii) 8.5-9.0 MHz; (xxiii) 9.0-9.5 MHz; (xxiv) 9.5-10.0 MHz; and (xxv) >10.0 MHz.

The cooling cell of the present invention is preferably utilised upstream of the pusher electrode(s) in an orthogonal acceleration time of flight mass spectrometer. The cooling cell reduces the velocity spread of ions leaving the cell and hence reduces the aberration due to ion 'turn around time' ($d_{TOF}$) in the time of flight (TOF) instrument. This leads to an improvement in the resolving power of the instrument.

More specifically, the concept involves reducing the temperature, and hence kinetic energy, of analyte ions immediately prior to mass analysis in the TOF mass analyser. In a high performance TOF system the ion 'turn around time' is a dominant resolution-limiting aberration. Ignoring other aberrations that are less difficult to correct, the ultimate resolution of a TOF instrument is fundamentally limited to a value that is inversely proportional to the orthogonal velocity spread of the ions. It is therefore desirable to reduce this velocity spread as much as possible.

The initial orthogonal ion velocity component is proportional to the square root of the temperature of the bath gas in which the ions reside. Therefore, by cooling the bath gas the ultimate resolving power of the TOF system can be improved. If the temperature of the bath gas in a conventional TOF instrument is $T_{conv}$ and the temperature of the bath gas is reduced to Low this invention increases the ultimate resolving power attainable by a factor of the square root of $T_{conv}/T_{cold}$. By way of example, assuming that the bath gas in a conventional TOF instrument is at 300 Kelvin and the temperature of the bath gas in the preferred embodiment of the present invention is cooled with liquid nitrogen to 77 K, then the improvement in resolving power is approximately 2 fold. Similarly, if the bath gas was cooled according to the preferred embodiment using liquid helium to a temperature of 4K then the improvement would be a factor of approximately 9.

The present invention reduces the kinetic energy of ions within the cooling cell by applying cryogenic techniques to reduce the temperature of the bath gas within the cell. The low temperature bath gas acts to reduce the kinetic energy of the ions through collisional cooling between the bath gas molecules and the ions. The preferred embodiment has the effect of reducing the velocity spread of ions leaving the collisional cooling cell and leads to a reduced 'turn around time' ($d_{TOF}$) in the TOF mass analyser and an improved resolving power.

By cooling the analyte ions according to the preferred method the product of ion velocity and spatial distribution (i.e. phase space) is significantly compressed prior to the ions leaving the cooling cell. This improves the resolving power for a given (or required) ion transmission, or to put it another way, provides higher transmission at a given or required resolving power. In order to exploit the benefits of either increased resolving power and/or increased transmission it is preferable to use appropriately designed Einzel transfer optics in order to provide a degree of magnification and collimation of the ion beam.

BRIEF DESCRIPTION OF THE DRAWINGS

Various embodiments of the present invention will now be described, by way of example only, and with reference to the following drawings, in which.

DETAILED DESCRIPTION OF THE PREFERRED EMBODIMENTS

Figure 1A:
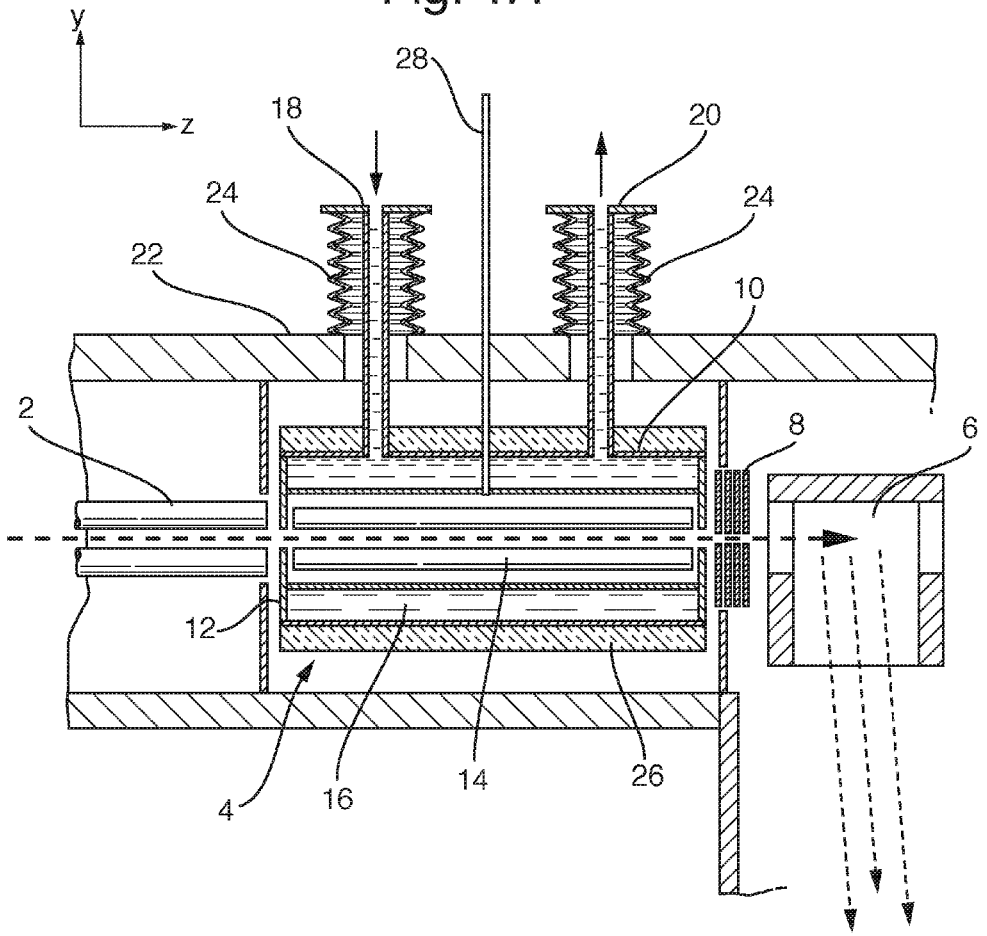
FIG. 1A shows a preferred embodiment of part of a mass spectrometer including an ion cooling cell.
Figure 1B:
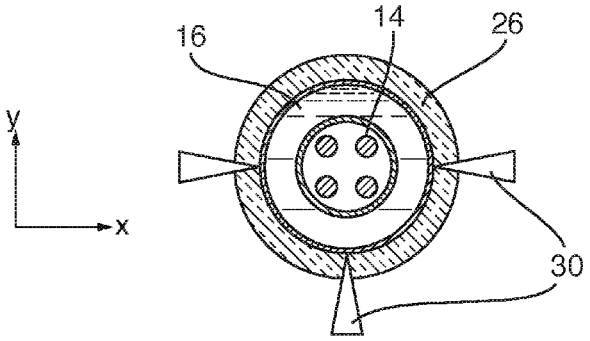
FIG. 1B shows a cross section through the ion cooling cell of FIG. 1A.

A preferred embodiment of the present invention will now be described with reference to the drawings. FIG. 1A depicts a portion of a mass spectrometer comprising a quadrupole rod set 2, an ion cooling cell 4 and an orthogonal acceleration time of flight mass analyser 6. Ions are guided through the quadrupole rod set 2 and into the ion cooling cell 4, in which the kinetic energy of the ions is to be reduced. After the ions have been cooled they are transferred into the extraction region of the TOF mass analyser 6 via transfer optics 8.

As mentioned above, the ion cooling cell 4 is provided so as to reduce the kinetic energy of the ions prior to mass analysis in the TOF mass analyser 6. The cooling cell 4 has an inner chamber defined by a circumferential wall 10 and end plates 12. Ions pass into the chamber through an entrance aperture in one of the end plates 12 and pass out of the chamber through an exit aperture in the other of the end plates 12. A quadrupole rod set 14 is arranged within the chamber for guiding ions from the entrance aperture to the exit aperture.

A cooling jacket 16 is provided around the circumferential wall 10 of the chamber. The cooling jacket 16 provides an enclosure that surrounds the wall and which receives cooling fluid. The cooling jacket 16 comprises an inlet line 18 for receiving the cooling fluid and an outlet line 20 for venting cooling fluid. The inlet and outlet lines are mounted to supporting surfaces 22 via bellows 24 which are configured to maintain the inlet 18 and outlet 20 lines coupled to the supporting surfaces 22 even when the lines exhibit thermal contraction and expansion and change in length. The cooling cell comprises an insulating layer 26 arranged around the outside of the cooling jacket 16. A capillary line 28 is provided for feeding bath gas through the wall 10 of the chamber into the region in which the ions are contained.

The operation of the preferred embodiment will now be described. Ions transmitted by the quadrupole 2 are passed into the entrance aperture of the cooling cell 4. The quadrupole 2 may be operated as a mass filter to selectively pass ions of predetermined mass to charge ratio or may simply be operated as an ion guide. The ions pass into the chamber of the ion cooling cell 4 and are radially confined within the quadrupole rod set 14, which prevents the ions from impacting on the wall 10 of the chamber. This radial confinement is achieved by applying RF potentials to the electrodes of the rod set 14, as is well known in the art. Bath gas is also present within the chamber and is delivered through the chamber wall 10 by the capillary line 28.

The ions are then cooled by the following technique. A cooling fluid, e.g. liquid nitrogen or liquid helium, is pumped into the inlet line 18 of the cooling jacket 16. This cooling fluid passes through the jacket 16 and out of the outlet line 20, removing heat from the wall 10 of the chamber as it does so. The cooling fluid may be re-cooled after exiting the outlet line 20 and recycled back into the inlet line 18. This process cools the wall 10 of the chamber, which in turn removes heat from the bath gas within the chamber. The molecules of the bath gas collide with the ions within the chamber and so the bath gas removes energy from the ions. The cooling jacket 16 therefore ultimately serves to remove energy from the ions and hence reduces the kinetic energy of the ions.

The apertures in the end plates 12 preferably act as differential pumping apertures, since the cooling cell is preferably arranged in a vacuum chamber, to help contain the low temperature bath gas within the chamber of the cooling cell. These end plates 12 may also be cooled via thermal conduction with the cooling jacket 16. The pressure in the cooling cell chamber should be maintained relatively low (e.g. a few mBar) using either conventional pumping methods or by using the cryogenic cooling afforded by the cooling jacket 16 itself.

The thermal insulator 26 surrounding the cooling jacket 16 helps to prevent the cooling jacket from absorbing heat from the atmosphere outside of the cooling cell. This reduces the heat load on the cooling jacket 16 and minimises cooling fluid boil off rates and/or the refrigeration power required to cool the cooling fluid before it is recycled back into the cooling jacket. Multiple layers of radiation shielding materials, such as biaxially-oriented polyethylene terephthalate, may be wrapped around the cooling jacket to reduce the heat load from radiation. A plurality of cooling jackets may be utilised, especially when temperatures close to liquid helium are implemented.

It is preferred to support the various components of the cooling cell using supports 30 of low thermal conductivity. For example, adjustable yet thin titanium mechanical supports may be provided. The cooling fluid inlet and outlet ports may be connected to the system through thin wall stainless steel and bellows 24 to accommodate thermal expansion. Low thermal conductivity wire may be used to apply the +/−RF voltages to the quadrupole rods within the ion cooling cell.

After the ions have been sufficiently cooled they are transported to the exit aperture and passed through the transfer optics 8 and into the extraction region of the TOF mass analyser 6. The ions may be urged through and out of the chamber, for example, by using a DC potential gradient. The ions are then mass analysed in the TOF mass analyser 6 with improved resolution since their kinetic energies have been reduced.

Although the present invention has been described with reference to preferred embodiments, it will be understood by those skilled in the art that various changes in form and detail may be made without departing from the scope of the invention as set forth in the accompanying claims. For example, cooling methods other than those described could be used to cool the cooling fluid and cooling jacket, such as expansion-compression systems, Stirling Engines, pulse tube cryocoolers, Joule Thompson effect refrigerators or thermo-electric Peltier devices.

Figure 2A:
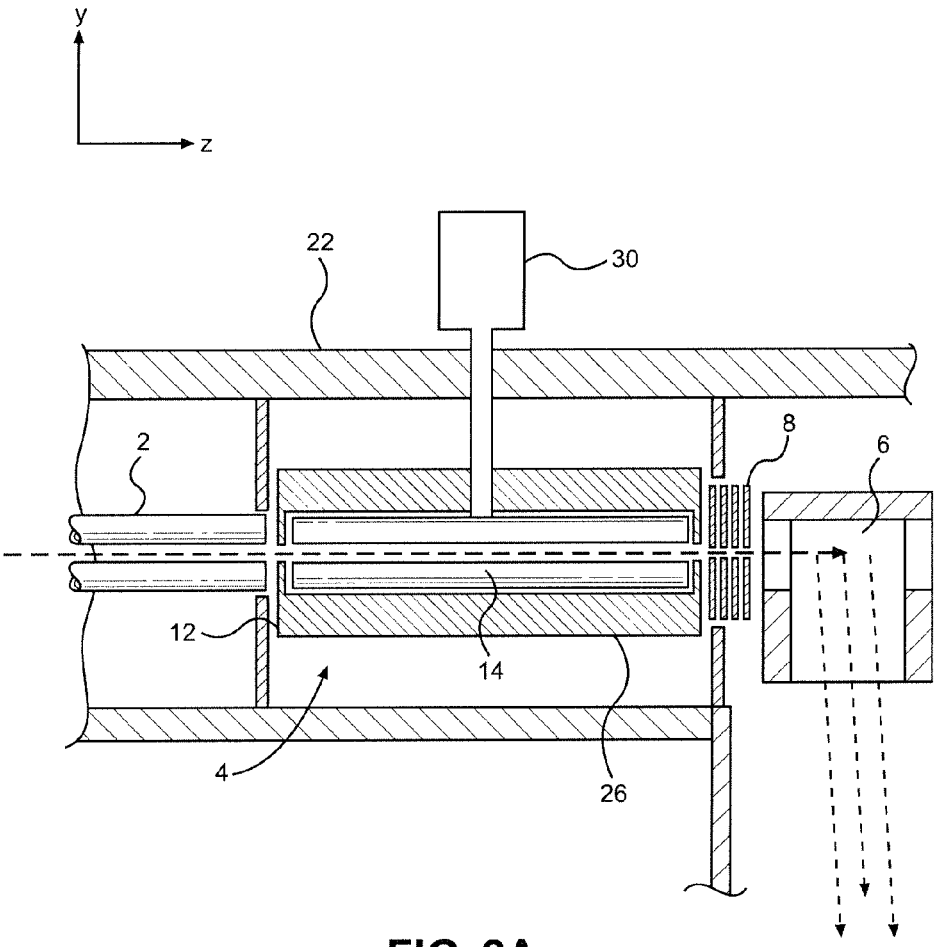
FIG. 2A shows another preferred embodiment of a mass spectrometer including an ion cooling cell wherein ions are cooled by laser cooling.
Figure 2B:
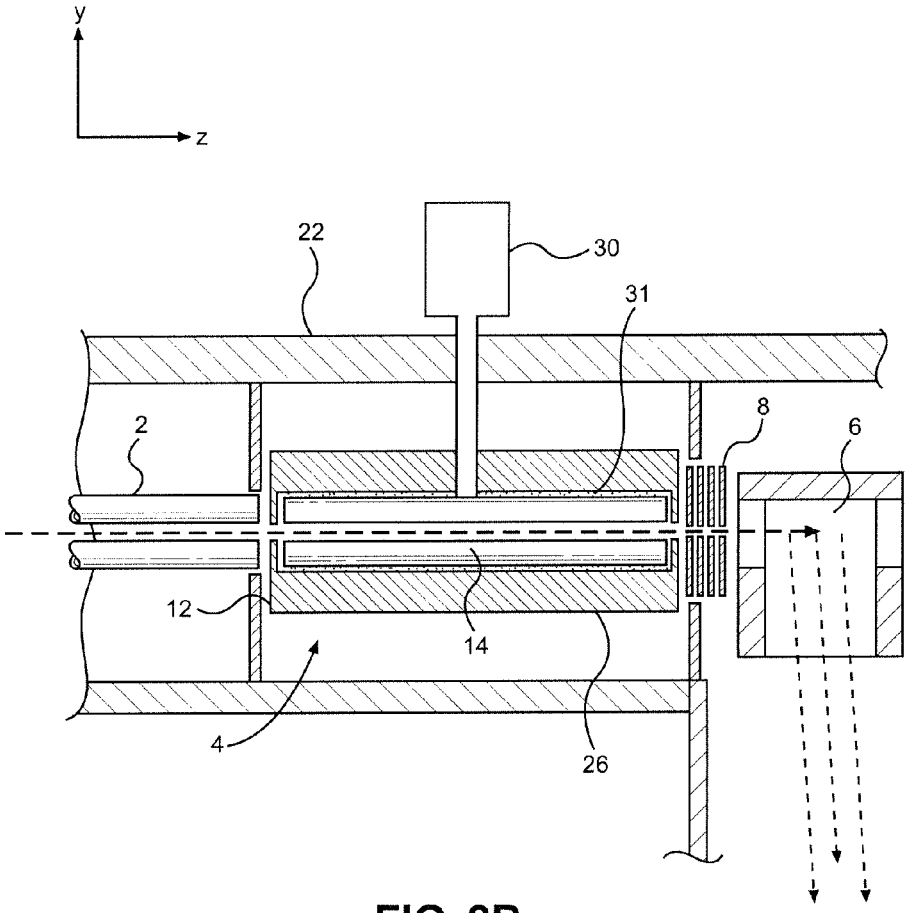
FIG. 2B shows another preferred embodiment of a mass spectrometer including an ion cooling cell wherein ions are cooled by sympathetic laser cooling.

The present invention also contemplates other methods of cooling ions before they are mass analysed. For example, the ions may be cooled to reduce their kinetic energy using laser cooling using a laser 30, as shown in FIG. 2A or sympathetic laser cooling, as shown in FIG. 2B. Such forms of laser cooling are known in the art for other purposes such as reducing the energy of ions in order to enable them to be trapped. However, it is not thought to be known to use laser cooling in order to cool ions so that the cooled ions can be mass analysed with improved resolution. For the avoidance of doubt, the term sympathetic laser cooling used herein is intended to mean that the laser 30 is used to cool particles 31 and those particles 31 then interact with the ions in order to cool the ions. For example, the particles 31 may be atomic ions that are cooled directly by laser cooling and the cooled atomic ions then interact with the other ions to be mass analysed so as to cool those other ions. This technique is useful for cooling ions that are unable to be cooled directly by laser cooling, such as ions from large organic molecules.

Figure 3:
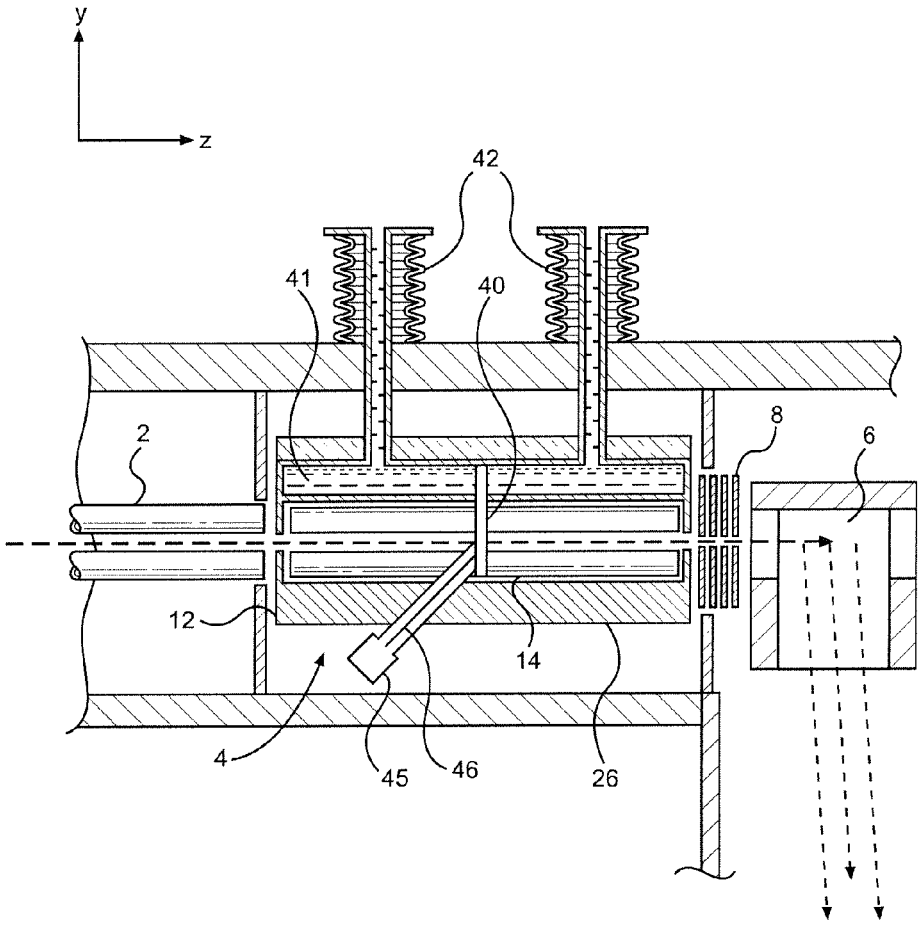
FIG. 3 shows a preferred embodiment of a mass spectrometer including a target plate used to generate ions or to dissociate ions.

The present invention also contemplates cooling target plates 40 as shown in FIG. 3 used to generate ions or to dissociate ions. For example, a SID (surface induced dissociation) target plate 40 may be cooled using the techniques described herein prior to mass analysis. These techniques may be used in order to improve mass resolution during mass analysis of the ions generated using the target plates. These techniques could also be used to cool the ions for other purposes, such as to improve the trapping of the ions.

Accordingly, from another aspect the present invention provides a method of mass spectrometry comprising: providing a target plate 40 having analyte disposed thereon; cooling the target plate 40; firing a laser 45 at said analyte arranged on the cooled target plate 40 so as to generate analyte ions; and mass analysing said ions.

From another aspect the present invention provides a method of mass spectrometry comprising: providing a target plate 40 for fragmenting ions; cooling the target plate 40; directing precursor ions onto the cooled target plate 40 such that the precursor ions fragment into daughter ions; and mass analysing said daughter ions.

The target plate 40 in latter two methods described above may be cooled by using a cooling fluid 41 to conduct heat away from the target plate 40.

In the above methods that utilise the target plates 40, the ions may be mass analysed by a time of flight mass analyser 6, optionally an orthogonal acceleration time of flight mass analyser.

The present invention also provides a mass spectrometer comprising: a target plate 40 on which analyte is disposed in use; means 41 and 42 for cooling the target plate; means for generating and directing laser light 46 onto said target plate so that, in use, said laser light 46 strikes said analyte and generates analyte ions; and a mass analyser for mass analysing said analyte ions.

The present invention also provides a mass spectrometer comprising: a target plate 40 for fragmenting ions that impact on said target plate 40; means for cooling the target plate 40; means for directing precursor ions onto the target 40 plate such that, in use, the precursor ions impact the target plate 40 and fragment into daughter ions; and a mass analyser for mass analysing said daughter ions.

The above mass spectrometers that comprise the target plates may comprise means 42 for supplying fluid coolant 41 to the target plate 40 for conducting heat away from the target plate.

The invention claimed is:

1. A mass spectrometer comprising:

a cooling cell for cooling ions so as to reduce their kinetic energy, the cooling cell comprising: a chamber for receiving said ions or for generating said ions therein, said chamber being formed from chamber walls defining a substantially enclosed region; and a cooling jacket surrounding said chamber, wherein said cooling jacket is arranged and configured to contain a cooling fluid and so as to remove heat from one or more of the chamber walls;

wherein the mass spectrometer further comprises a mass analyser for receiving said ions from the cooling cell after they have been cooled; and wherein the mass analyser is arranged and the mass spectrometer is configured such that ions cooled by the cooling cell are received at the mass analyser and mass analysed whilst still cooled relative to their kinetic energies prior to the ions entering the cooling cell so that the range of velocities of the ions is reduced relative to the range of velocities of the ions prior to entering the cooling cell.

2. The mass spectrometer of claim 1, wherein the cooling jacket comprises a fluid inlet line for receiving said cooling fluid and a fluid outlet line for venting the cooling fluid out of the cooling jacket.

3. The mass spectrometer of claim 2, further comprising means for flowing said cooling fluid into the jacket through said inlet line, through the jacket and then out of the jacket through the outlet line.

4. The mass spectrometer of claim 2, wherein at least a portion of the inlet line or outlet line is connected to a mounting surface in the mass spectrometer in a manner so that the inlet line or outlet line may move relative to the mounting surface so as to accommodate thermal expansion or contraction of the inlet line or outlet line.

5. The mass spectrometer of claim 1, further comprising a gas line extending through a wall of the chamber for supplying gas into the chamber, the gas for being cooled inside the chamber as a result of the cooling fluid in the cooling jacket.

6. The mass spectrometer of claim 5, wherein the chamber comprises an ion entrance aperture for allowing the chamber to receive ions to be cooled, an ion exit aperture for allowing cooled ions to exit the chamber, and further comprising a gas-line inlet opening for allowing the chamber to receive gas to be cooled; and wherein the walls of the cooling chamber define a fully enclosed region except for said ion entrance aperture, said ion exit aperture and said gas-line inlet opening.

7. The mass spectrometer of claim 5, wherein the cooling cell is arranged in a vacuum housing or between vacuum housings such that, in use, the gas pressure inside said cooling chamber is higher than the gas pressure of said vacuum housing(s).

8. The mass spectrometer of claim 6, wherein the chamber is an elongated chamber having an ion entrance aperture and an ion exit aperture at opposing longitudinal ends of the chamber, and wherein the gas line inlet opening is arranged through a chamber wall in a longitudinally central region of the chamber between the longitudinal ends of the chamber.

9. The mass spectrometer of claim 5, wherein the gas inlet line extends through a channel through the cooling jacket to reach the cooling chamber.

10. The mass spectrometer of claim 1, further comprising means for generating electric or magnetic fields for confining ions within said chamber such that the ions do not impact on one or more walls of the chamber.

11. The mass spectrometer of claim 1, comprising means to drive ions through said chamber and out of an exit aperture.

12. The mass spectrometer of claim 1, wherein the mass analyser is a time of flight mass analyser, optionally an orthogonal acceleration time of flight mass analyser.

13. A method of mass spectrometry comprising:

providing an ion cooling cell comprising a chamber having walls defining a substantially enclosed region and a cooling jacket surrounding said chamber;

providing ions in said chamber;

supplying a cooling fluid into the cooling jacket so as to remove heat from one or more walls of the chamber, thereby cooling a gas within the chamber and the ions within the chamber; and mass analysing the cooled ions, wherein the ions that are mass analysed are cooled relative to their kinetic energies prior to the ions entering the cooling cell so that the range of velocities of the ions is reduced relative to the range of velocities of the ions prior to entering the cooling cell.

14. The method of claim 13, further comprising flowing said cooling fluid into the jacket through an inlet line, through the jacket and then out of the jacket through an outlet line.

15. The method of claim 14, wherein cooling fluid exiting the jacket through the outlet line is refrigerated and recycled back into the jacket through the inlet line.

16. The method of claim 13, further comprising supplying said gas into the chamber through a wall of the chamber.

17. The method of claim 16, wherein the chamber further comprises an ion entrance aperture and an ion exit aperture, and wherein said gas is supplied into said chamber at a rate such that the gas pressure within the chamber is higher than the gas pressure outside said chamber at said ion entrance aperture or ion exit aperture.

18. The method of claim 13, further comprising confining ions within said chamber using electric or magnetic fields such that the ions do not impact on one or more walls of the chamber.

19. The method of claim 13, further comprising urging ions through said gas in the chamber and out of an exit aperture of the chamber.

20. The method of claim 13, comprising mass analysing the cooled ions in a time of flight mass analyser, optionally in an orthogonal acceleration time of flight mass analyser.

21. A method of mass spectrometry comprising:

supplying ions to an ion cooling region;

cooling the ions to a cooled state by removing kinetic energy from the ions, wherein the ions are cooled directly by laser cooling or are cooled indirectly by sympathetic laser cooling;

supplying ions in the cooled state to a mass analyser; and mass analysing the ions, wherein the ions that are mass analysed are cooled relative to their kinetic energies prior to the ions entering a cooling cell so that the range of velocities of the ions is reduced relative to the range of velocities of the ions prior to entering the cooling cell.

22. A method of mass spectrometry conducted using a target plate for fragmenting ions, the method comprising:

cooling the target plate;

directing precursor ions onto the cooled target plate such that the precursor ions fragment into daughter ions; and mass analysing said daughter ions.

23. The method of claim 22, wherein the target plate is cooled by using a cooling fluid to conduct heat away from the target plate.

24. The method of claim 21, wherein the ions are mass analysed by a time of flight mass analyser, optionally an orthogonal acceleration time of flight mass analyser.

25. A mass spectrometer comprising:

a target plate for fragmenting ions that impact on said target plate;

means for cooling the target plate;

means for directing precursor ions onto the target plate such that, in use, the precursor ions impact the target plate and fragment into daughter ions; and a mass analyser for mass analysing said daughter ions.

26. The mass spectrometer of claim 25, comprising means for supplying fluid coolant to the target plate for conducting heat away from the target plate.

27. The mass spectrometer of claim 25, wherein the mass analyser is a time of flight mass analyser, optionally an orthogonal acceleration time of flight mass analyser.

* * * * *